US012398556B2

(12) United States Patent
Torres et al.

(10) Patent No.: US 12,398,556 B2
(45) Date of Patent: Aug. 26, 2025

(54) VENTILATION MEMBER AND SYSTEMS INCORPORATING THE SAME

(71) Applicant: Stockton Products, North Las Vegas, NV (US)

(72) Inventors: Angelberto Torres, La Puente, CA (US); Thomas Arthur Anderberg, Oakland, CA (US); Don Pilz, Livermore, CA (US)

(73) Assignee: STOCKTON PRODUCTS, Las Vegas, NV (US)

( * ) Notice: Subject to any disclaimer, the term of this patent is extended or adjusted under 35 U.S.C. 154(b) by 179 days.

(21) Appl. No.: 18/046,888

(22) Filed: Oct. 14, 2022

(65) Prior Publication Data

US 2023/0122577 A1 Apr. 20, 2023

Related U.S. Application Data

(60) Provisional application No. 63/256,506, filed on Oct. 15, 2021.

(51) Int. Cl.
*E04B 1/70* (2006.01)
*E04F 19/02* (2006.01)

(52) U.S. Cl.
CPC ..... *E04B 1/7069* (2013.01); *E04F 19/02* (2013.01)

(58) Field of Classification Search
CPC ..... E04B 1/7069; E04B 1/765; E04F 19/02; E04F 19/061; E04F 13/007
See application file for complete search history.

(56) References Cited

U.S. PATENT DOCUMENTS

| | | | | |
|---|---|---|---|---|
| 4,391,074 | A | 7/1983 | Holsman | |
| 5,630,297 | A | 5/1997 | Rutherford | |
| 6,385,932 | B1 | 5/2002 | Melchiori | |
| 7,673,421 | B2 | 3/2010 | Pilz | |
| 7,874,123 | B2 | 1/2011 | Maziarz | |
| 8,082,713 | B2 | 12/2011 | Matthews | |
| 8,584,416 | B2 | 11/2013 | Chenier | |
| 9,279,247 | B2 | 3/2016 | Maziarz | |
| 9,963,875 | B1 * | 5/2018 | Prygon | E04C 2/528 |
| 10,024,063 | B2 | 7/2018 | Friel | |
| 10,221,586 | B2 | 3/2019 | Mayer, Jr. | |
| 10,494,818 | B2 | 12/2019 | Maziarz | |
| 10,533,324 | B2 | 1/2020 | Baltz, Jr. et al. | |

(Continued)

OTHER PUBLICATIONS

Koester, John H., "Getting to the Bottom of Moisture Management", 2015 Masonry Technology Inc., 7 pages.

*Primary Examiner* — Patrick J Maestri
(74) *Attorney, Agent, or Firm* — WOMBLE BOND DICKINSON (US) LLP

(57) ABSTRACT

A ventilation member includes a base panel for mounting onto a substrate, an upper panel extending transversely from the base panel, a lower panel spaced apart from the upper panel, and an inner panel extending transversely from the lower panel. A passageway is defined having a first portion defined between the base panel and the inner panel and a second portion extending transversely from the first portion and being defined between the upper and the lower panel. When used as part of a system, the ventilation member may be an upper ventilation member and the system may include a second lower ventilation member including a base panel and a leg extending transversely thereof.

45 Claims, 5 Drawing Sheets

(56) References Cited

U.S. PATENT DOCUMENTS

| | | | | |
|---|---|---|---|---|
| 10,570,640 | B2 | 2/2020 | Mayer, Jr. | |
| 10,655,336 | B2 | 5/2020 | Friel | |
| D887,586 | S | 6/2020 | Baltz, Jr. et al. | |
| D888,285 | S | 6/2020 | Baltz, Jr. et al. | |
| 10,669,721 | B2 | 6/2020 | Baltz, Jr. et al. | |
| D889,247 | S | 7/2020 | Baltz, Jr. et al. | |
| D893,051 | S | 8/2020 | Baltz, Jr. et al. | |
| 10,731,335 | B2 | 8/2020 | Baltz, Jr. et al. | |
| 10,731,354 | B2 | 8/2020 | Friel | |
| 10,745,960 | B1 * | 8/2020 | Hutchins | E06B 1/702 |
| 10,753,083 | B2 | 8/2020 | Baltz, Jr. et al. | |
| D896,993 | S | 9/2020 | Baltz, Jr. et al. | |
| 10,774,545 | B2 | 9/2020 | Baltz, Jr. et al. | |
| D902,443 | S | 11/2020 | Baltz, Jr. | |
| D903,146 | S | 11/2020 | Baltz, Jr. et al. | |
| D904,649 | S | 12/2020 | Maldonado et al. | |
| D905,295 | S | 12/2020 | Baltz, Jr. et al. | |
| 10,947,722 | B2 | 3/2021 | Baltz, Jr. et al. | |
| 10,968,635 | B1 * | 4/2021 | Duran | E04D 3/363 |
| D923,821 | S | 6/2021 | Baltz, Jr. et al. | |
| 11,180,913 | B2 | 11/2021 | Baltz, Jr. et al. | |
| 11,180,928 | B2 | 11/2021 | Mayer, Jr. | |
| D940,349 | S | 1/2022 | Baltz, Jr. et al. | |
| D940,350 | S | 1/2022 | Baltz, Jr. et al. | |
| 2016/0208484 | A1 * | 7/2016 | Pilz | E04B 2/7411 |
| 2017/0226732 | A1 * | 8/2017 | Collins | E04B 1/765 |
| 2017/0254091 | A1 | 9/2017 | Friel | |
| 2019/0161960 | A1 * | 5/2019 | Baltz, Jr. | E04F 13/068 |
| 2020/0370311 | A1 * | 11/2020 | Koethe | E04F 19/061 |
| 2022/0205236 | A1 * | 6/2022 | Kato | E04F 19/061 |

* cited by examiner

VENTILATION MEMBER AND SYSTEMS INCORPORATING THE SAME

CROSS-REFERENCE TO RELATED APPLICATION

This application is based upon and claims priority to U.S. Provisional Application No. 63/256,506 filed Oct. 15, 2021, the contents of which are fully incorporated herein by reference.

BACKGROUND

Stucco, plaster or other claddings are typically used for exterior surfaces of building structures defining substrates such as walls. Such claddings are applied over a wire mesh over felt paper which has been attached to underlying substrate, e.g. wall. This method of cladding installation often results in leak problems between the cladding and the substrate and often results in the collection of moisture between the cladding and substrate.

Weep screeds are often used with claddings over walls towards a bottom end of the wall or mid-wall (as for example externally between floors) to act as a stop for the cladding applied to the wall. Weep screeds generally have a panel that abuts the wall and a leg that extends transversely outward to provide a surface for the cladding to contact. The weep screed also allows moisture to be collected between the cladding and the substrate to drain. However, better drainage systems are desired that allow for venting of the moisture collected between the substrate and the cladding upwards and that can be used in with systems that allow for drainage of moisture downwards.

SUMMARY

In an example embodiment, a ventilation member includes a base panel for mounting onto a substrate, an upper panel extending transversely from the base panel, a lower panel spaced apart from the upper panel, and an inner panel extending transversely from the lower panel. A passageway is formed having a first portion defined between the base panel and the inner panel and a second portion extending transversely from the first portion and defined between the upper and the lower panels. In another example embodiment, the ventilation member further includes a connecting panel connecting the upper and lower panels at distal ends thereof. In yet another example embodiment, a vent opening is formed through a distal portion of the lower panel for venting the passageway. With this example embodiment, the ventilation member may further include a guide extending transversely from the lower panel for providing a guide for the addition of an exterior cladding. In yet a further example embodiment, the ventilation member also includes a leg extending from the lower panel at a distal end thereof. With this example embodiment, the vent opening is located between the guide and the leg. In yet a further example embodiment, the inner panel extends upward from the lower panel. In another example embodiment, the ventilation member also includes a vent panel extending from the base panel to the inner panel and having at least one opening. In one example embodiment, the ventilation member further includes a vertical panel extending from a distal end of the upper panel toward the lower panel defining a gap between a distal end of the vertical panel and a distal end of the lower panel for venting. In another example embodiment, the ventilation member also includes a guide extending from the distal end of the lower panel. In yet a further example embodiment, the base panel includes a second wall over a first wall, such that the upper panel extends from the first wall and the lower panel extend from the second wall. In an example embodiment, the base panel is for being sandwiched between a substrate and a water resistive barrier layer. In another example embodiment, the base panel is for being mounted on a substrate covered by a water resistive barrier layer. In yet another example embodiment, the base panel, the upper panel, the lower panel and the inner panel are integrally formed from a single layer of material. In yet another example embodiment the ventilation member further includes at least one protrusion extending from at least one of the base panel and the inner panel and into the passageway first portion. In a further example embodiment, the ventilation member also includes a vent panel including at least one opening and extending from the base panel to the inner panel.

In a further example embodiment, a structure venting system includes a substrate being part of the structure as well as a first ventilation member which includes a base panel mounted to the substrate, an upper panel extending transversely from the base panel, a lower panel spaced apart from the upper panel, and an inner panel extending transversely from the lower panel. A passageway is formed having a first portion defined between the base panel and the inner panel and a second portion extending transversely from the first portion and defined between the upper and the lower panel. The system also includes a water resistive barrier layer adjacent the base panel, and a drainage mat over the substrate and water resistive barrier layer and extending into the passageway first portion. In this regard, moisture collected in the drainage mat can vent through the passageway. In yet a further example embodiment, the water resistive barrier layer is over the base panel, such that the base panel is sandwiched between the substrate and the water resistive barrier layer. In another example embodiment, the water resistive barrier layer is over the substrate, such that the water resistive barrier layer is sandwiched between the substrate and the base panel. In an example embodiment, the system also includes a lath over the drainage mat, and a cladding over the lath. In a further example embodiment, the system further includes a connecting panel connecting the upper and lower panels at distal ends thereof. In yet a further example embodiment, a vent opening is formed through a distal portion of the lower panel for venting the passageway. In another example embodiment, the system further includes a guide extending transversely from the lower panel for providing a guide for an addition of the exterior cladding. In yet another example embodiment, the system also includes a leg extending from the lower panel at a distal end thereof. With this example embodiment, the vent opening is located between the guide and the leg. In yet a further example embodiment, the inner panel extends upward from the lower panel. In another example embodiment, the first ventilation member also includes a vent panel extending from the base panel to the inner panel and having at least one opening. In one example embodiment, the first ventilation member further includes a vertical panel extending from a distal end of the upper panel toward the lower panel defining a gap between a distal end of the vertical panel and a distal end of the lower panel for venting. In another example embodiment, the first ventilation member also includes a guide extending from the distal end of the lower panel. In yet a further example embodiment, the base panel includes a second wall over a first wall, such that the upper panel extends from the first wall and the lower panel extends from the second wall. In another example embodiment, the system includes a guide extending from the distal end of the lower panel for providing a guide for an addition of the exterior cladding. In yet another example embodiment the base panel includes a second wall over a first wall, such that the upper panel extends from the first wall and the lower panel extends from the second wall. In one example embodiment, the system includes at least one protrusion extending from at least one of the base panel and the inner panel and into the passageway first portion. The at least one protrusion acting as a stop for preventing travel of the drainage mat beyond the at least one protrusion. In a further example embodiment, the system also includes a vent panel having at least one opening and extending from the base panel to the inner panel. The vent panel may act as a stop for preventing travel of the drainage mat beyond said vent panel. In one example embodiment, the system further includes a second ventilation member. The second ventilation member includes a base panel. With this example embodiment, a portion of the water resistive barrier layer extends adjacent the second ventilation member base panel and a portion of the draining mat extends over the second ventilation member base panel and the portion of the water resistive barrier layer. A first leg also extends transversely from the second ventilation member. The first leg includes a drain opening aligned with the drainage mat, such that moisture within the drainage mat can drain through the drain opening. In another example embodiment, the second ventilation member includes a second leg extending transversely and downwardly from the second ventilation member base panel, spaced apart and below the first leg, such that moisture drained through the drain opening of the first leg drains on the second leg and is guided by the second leg. In a further example embodiment, the water resistive barrier layer is over the base panel of the ventilation member and over the base panel of the second ventilation member, such that the base panels are sandwiched between the substrate and the water resistive barrier layer. In yet a further example embodiment, the water resistive barrier layer is over the substrate, such that the water resistive barrier layer is sandwiched between the substrate and the base panel of the ventilation member and between the substrate and the base panel of the second ventilation member.

DESCRIPTION

Figure 1:
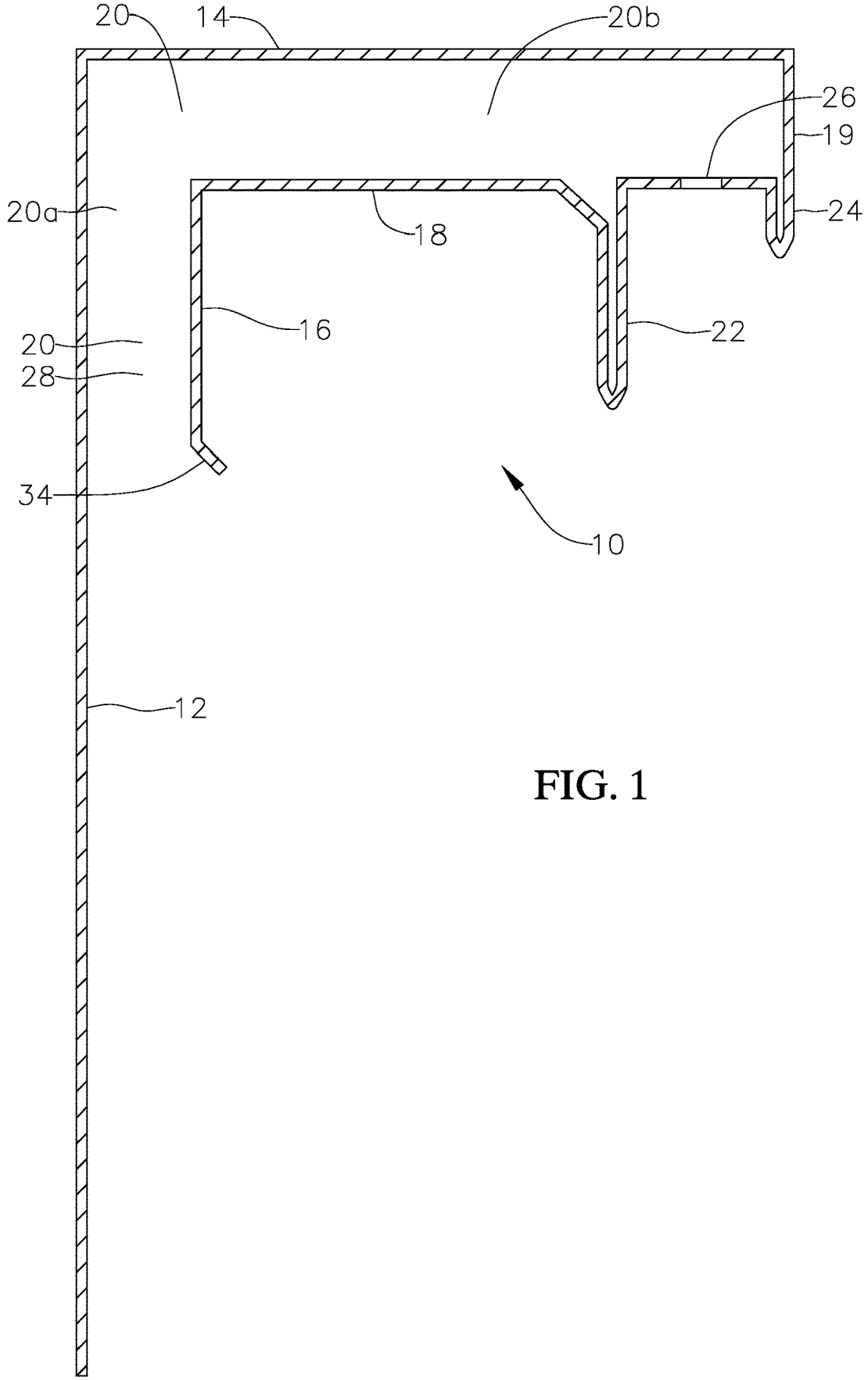
FIG. 1 is an end view of an example embodiment ventilation member.
Figure 2:
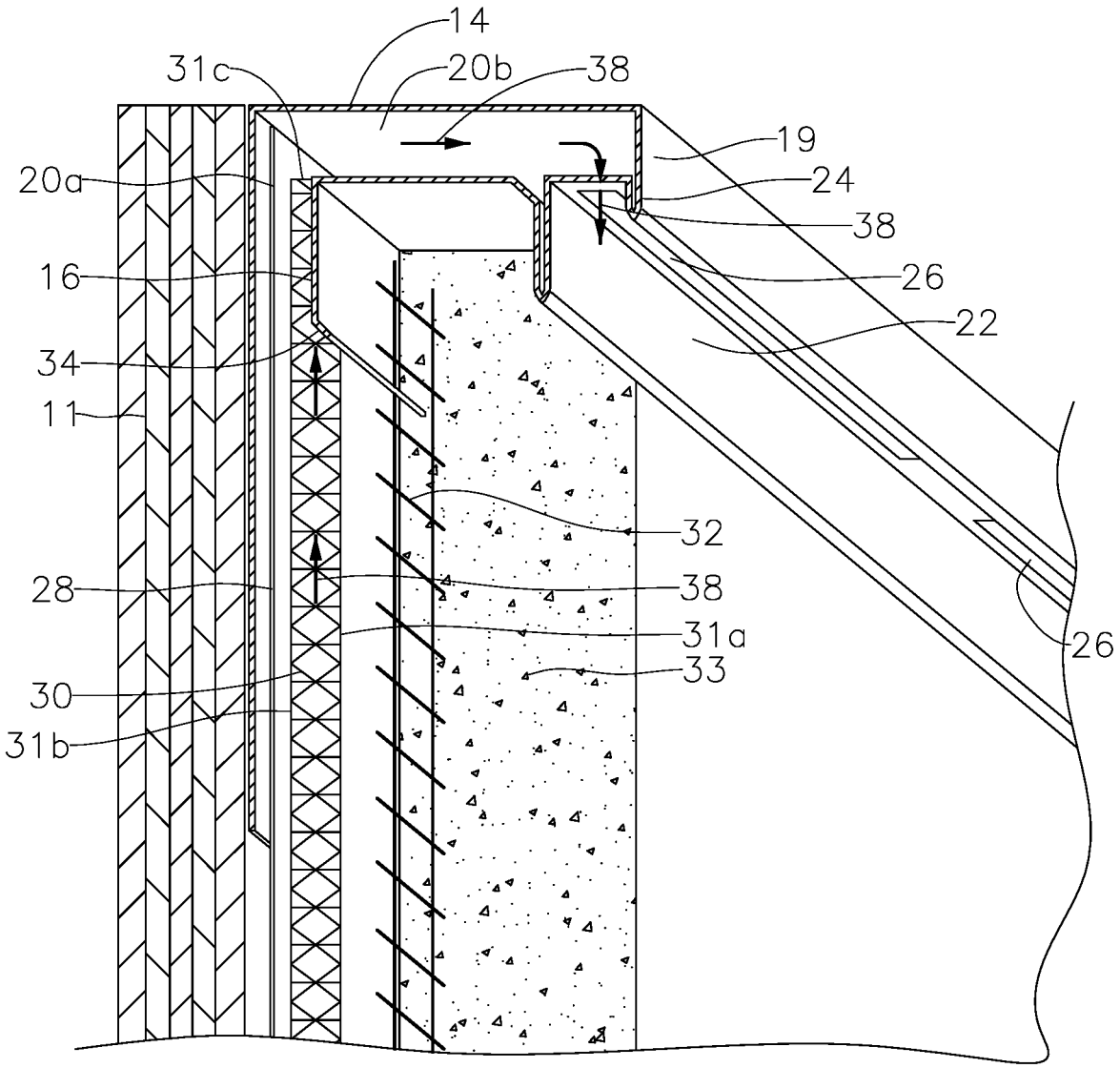
FIG. 2 is a partial perspective view of the example embodiment ventilation member shown in FIG. 1 installed between a cladding and a substrate.
Figure 3:
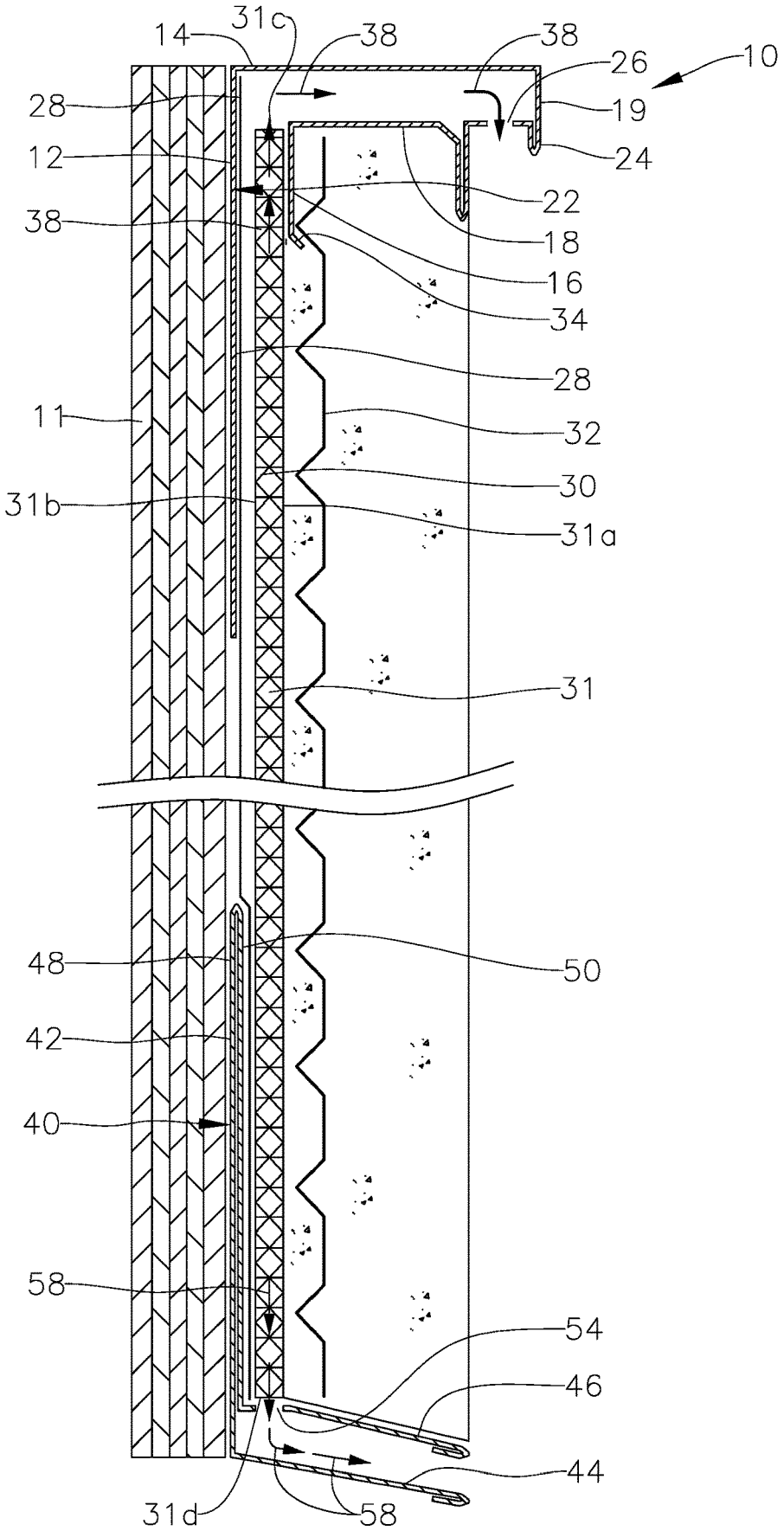
FIG. 3 is an end view of the example embodiment ventilation member show in FIG. 1 in combination with a lower ventilation member installed between a cladding a substrate.

An example embodiment ventilation member 10, as shown in the FIGS. 1, 2 and 3, includes a base panel or nailing flange 12 for being mounted on a substrate 11 (e.g., a of wall of a structure such as a building). The ventilation member includes an upper panel 14 extending transversely from the base panel 12. In an example embodiment, the upper panel 14 extends perpendicularly from the base panel 12. An inner panel 16 extends parallel from the base panel and a lower panel 18 extends transversely to the inner panel and parallel to the upper panel. A connecting panel 19, which in the example embodiment is a vertical panel, extends from the upper panel to the lower panel at distal ends of the upper and lower panels. A passageway 20 is defined between the upper and lower panels and between the base and inner panels. The passageway has a first portion 20*a* defined between the base panel and the inner panel and a second portion 20*b* extending transversely from the first portion and defined between the lower panel and the upper panel. A guide 22 extends transversely from the lower panel. In example embodiments a leg 24 is defined extending on the connecting panel 19, extending below the lower panel. The guide 22 provides a guide or reference for the addition of cladding over the ventilation member. At least one vent opening 26 is formed through a distal end portion of the lower panel distal from the guide. In an example embodiment, the at least one vent opening is a plurality of elongate slots. In an example embodiment where a leg 24 extends from the connecting panel 19, the at least one vent opening 26 is formed through the lower panel between the guide 22 and the leg 24. In example embodiments each of the panels, guide and leg may be separate members that are interconnected. In some example embodiment some of the panels, guide and leg may be formed integrally as part of one or more members that are interconnected. In an example embodiment, as shown in FIGS. 1, 2 and 3, all the panels, guide and leg are integrally formed from a single layer of material.

As shown in FIGS. 2 and 3, in use, the base panel is mounted to the wall or substrate 11. A water resistive barrier layer 28 is attached over the base panel covering the entire base panel 12 or substantially the entire base panel 12. In this regard the base panel 12 is sandwiched between the substrate 11 and the water resistive barrier layer 28. In another example embodiment, the water resistive barrier layer 28 may be placed between the base panel and the substrate prior to mounting of the base panel to the substrate. In another example embodiment, a first water resistive barrier layer is placed between the base panel and the substrate and a second water resistive barrier layer is placed over the base panel such that the base panel is sandwiched between the two water resistive barrier layers. In example embodiments, the water resistive barrier layer is a film type of material that resists penetration by water or moisture. Water resistive barriers are well known in the art. They are often barrier films or layers which resist penetration by water, moisture, or vapor.

A drainage mat 30 is positioned over the water resistive barrier layer and the base panel. Drainage mats are well known in the art and are used to absorb and drain moisture. Moisture may be in the form of vapor. "Drainage mat" as used herein refers to any type of structure can cover a surface area and is capable of absorbing and draining moisture. In an example embodiment, the drainage mat extends from below the base panel and within the passageway first portion 20*a*. In an example embodiment, the drainage mat extends so as to be adjacent to the second passageway portion 20*b* as for example shown in FIG. 3. In another example embodiment, the drainage mat extends within the first portion of the passageway up to the upper panel, or just below the upper panel but above the lower panel. An example embodiment drainage mat 30 as shown in FIGS. 2 and 3, has a first outer surface 31*a* opposite a second outer surface 31*b*. In an example embodiment at least the first outer surface 31*a*, or both outer surfaces 31*a*, 31*b*, of the drainage mat allow moisture to enter the drainage mat but resist the exit of moisture from within the drainage mat through such surfaces. With this example embodiment, the moisture taking the path of least resistance exits through the drainage mat opposite open ends 31*c*, 31*d*. As such, when using such drainage mat, it is desirable that the drainage mat extends within the first portion 20*a* of the passageway to a level below the upper panel, or at or below the lower panel 18, such that the drainage mat only extends to a location below the upper panel. As shown in FIGS. 2 and 3, the drainage mat extends up to the lower panel and the second portion of the passageway. In this regard, moisture within the drainage mat can escape and vent through its upper end 31*c* and through the second portion of the passageway. If the drainage mat extended all the way to the upper panel 14, the moisture would have to exit through the first outer surface 31*a* which would be a more restrictive exit flow than the upper open end 31*c* of the drainage mat.

Figure 4A:
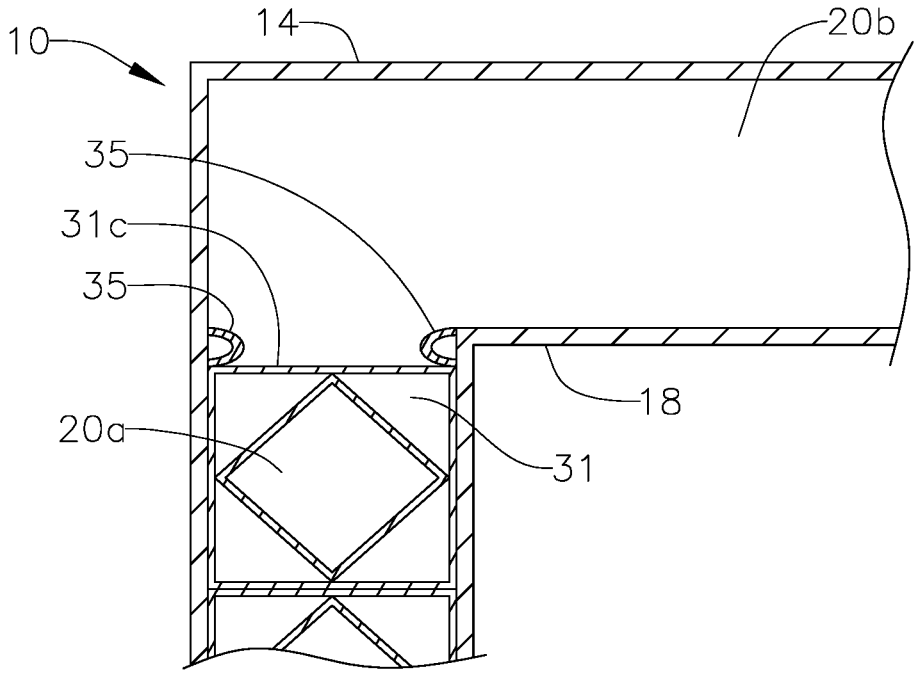
FIG. 4A is a partial end view of another example embodiment ventilation member.
Figure 4B:
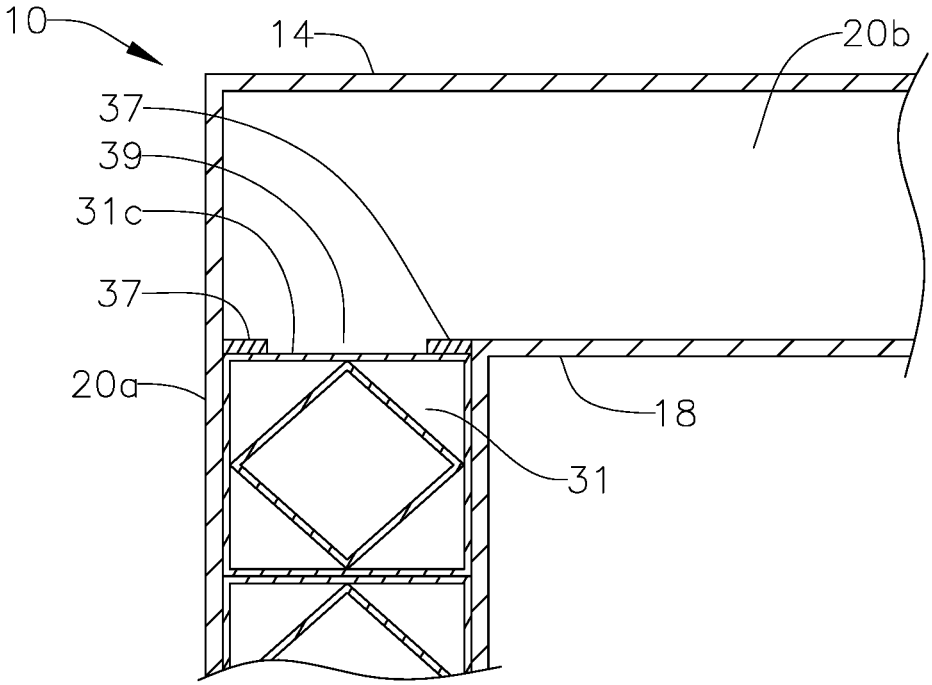
FIG. 4B is a partial end view of yet another example embodiment ventilation member.

In an example embodiment, to assist with proper placement of the drainage mat so that it will not extend within the second portion 20*b* of the passageway, one or more protrusions 35 may extend for either or both the base panel and the inner panel and within the first portion 20*a* of the passageway, as shown in FIG. 4A. The protrusion(s) act as stop(s) for the upper end 31*c* of the drainage mat. In this regard, during installation, the drainage mat can be pushed up until it is stopped by the protrusion(s) 35. In another example embodiment, instead of protrusion as shown in FIG. 4B, a vent panel 37 may be provided extending from the inner panel to the base panel to act as a stop for the upper end 31*c* of the drainage mat. The vent panel has at least one opening 39. In an example embodiment, the at least one opening is a plurality of elongate slots. With this embodiment, moisture within the drainage mat can vent from the end 31*c* of the drainage mat through the least one opening 39 of the vent panel and into the second portion 20*b* of the passageway for venting to the outside through at least one vent opening 26. In the shown example embodiment, the vent panel 37 is a horizontal panel extending between an upper end of the inner panel to the base panel. In another example embodiment, the vent panel extends from a level below the upper end of the inner panel to the base panel.

A lath 32 may be placed over the drainage mat and over the inner panel. Stucco or another cladding 33 is then placed over the lath and may extend up to the lower panel 18 having a thickness up to the guide 22. Besides stucco, the cladding may be plaster, wood, aluminum or any other material that may be used to cover a wall, especially an exterior wall. In an example embodiment, the inner panel 16 is formed to have an obliquely extending distal end portion 34 which penetrates and locks into the stucco or other cladding. In addition, the distal end portion also guides any moisture trapped between the inner panel and the cladding outward away from the substrate and toward the cladding. Furthermore, the obliquely extending end portion 34 of the inner panel serves to guide the insertion of the drainage mat 30 in the portion of the passage way between the inner panel and the water resistive layer. With these example embodiments, moisture collected in the drainage mat is vented, as shown by arrow 38, up through the drainage mat, through the passageway first portion 20*a*, the passageway second portion 20*b*, and out through the at least one vent opening 26 thereby venting into the atmosphere.

Figure 5:
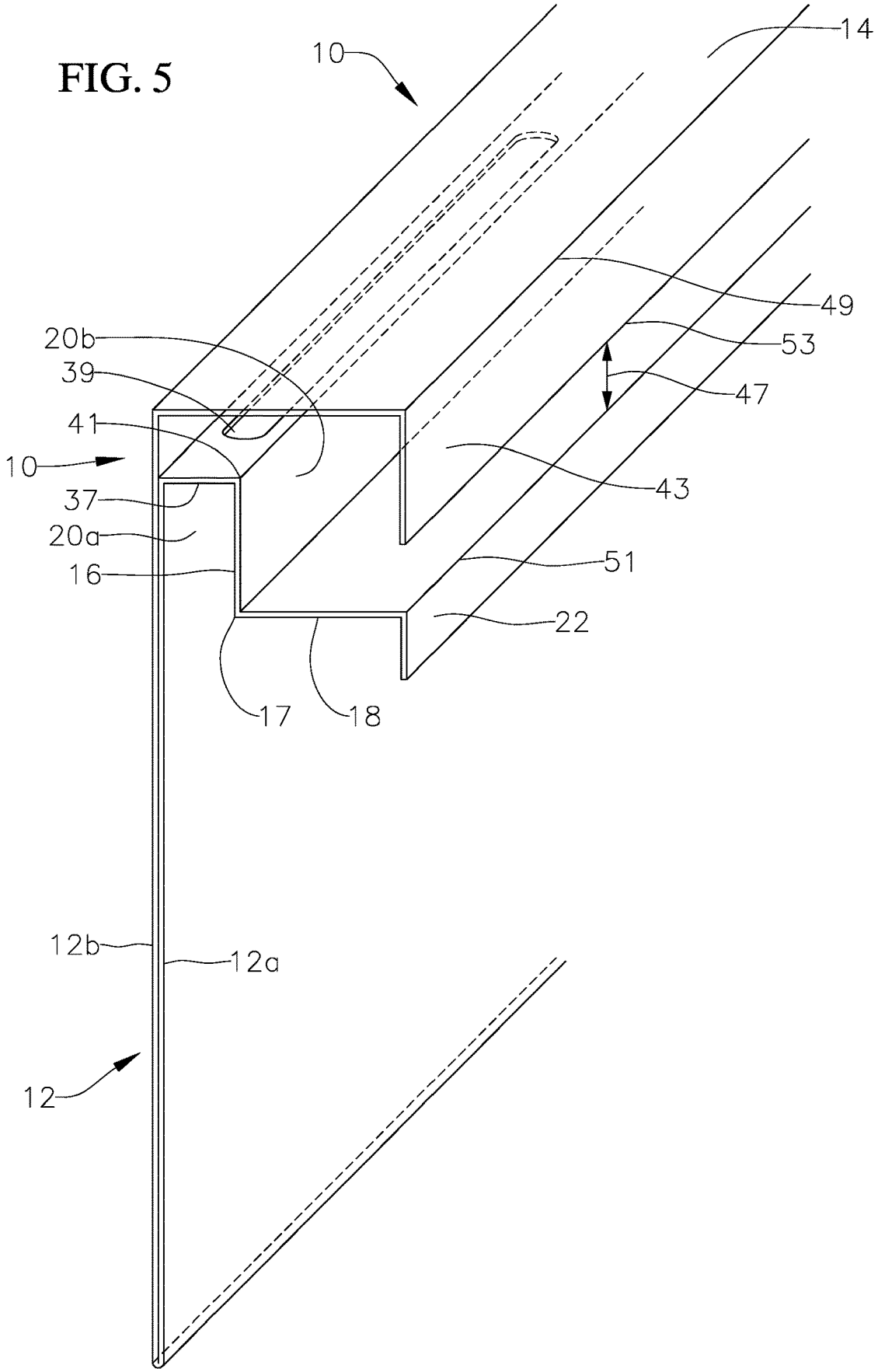
FIG. 5 is a partial perspective view of a further example embodiment ventilation member.

In another example embodiment, the lower panel 18 extends from a lower end 17 of the inner panel 16 as shown in FIG. 5, or at another location below the upper end 41 of the inner panel. In an example embodiment, both the upper panel 14 and the lower panel 18 extend distally relative to the base panel the same distance, or approximately the same distance, as measured from a surface of the base panel.

A vertical panel 43 may be provided extending from a distal end 49 of the upper panel 14 in a direction toward the lower panel 18 to a distance spaced apart from a distal end 51 the lower panel 18 such that a vent gap 47 is defined between a distal end 53 of the vertical panel 43 and the lower panel 18 distal end 51. In this regard moisture venting through the second portion 20*b* of the passageway will vent through the vent gap 47. With this example embodiment, vent openings are not formed through the distal end portion of the lower panel. In another example embodiment, the vertical panel is not provided such that the vent gap is defined between the distal ends 49, 51 of the upper and lower panels 14, 18, respectively. A guide 22 may be provided extending downward from the lower panel distal end. The vent panel 37 extends from the inner panel to the base panel. The vent panel serves as a stop when receiving the drainage mat and allows for venting of the drainage mat through the at least one opening 39 formed through the vent panel. In an example embodiment, the ventilation member 10 may be formed from a single sheet of material such as galvanized steel, as for example shown in FIG. 5. With this example embodiment, the sheet of material is folded over itself to form the base panel 12 such that base panel 12 has a first wall 12*a* and a second wall 12*b* over the first wall.

With this embodiment, the upper panel extends from the second wall while the lower panel extends from the first wall. In a further example embodiment, the first wall 12*a*, the vent panel 37, the inner panel 16, the lower panel 18, and the guide 22, are formed from one piece of material, while the second wall 12*b*, the upper panel 14 and the vertical panel 43 are formed from a second piece of material. In another example embodiment, instead of the vent panel 37, at least one protrusion is provided on the inner panel, or the base panel or both and extending within the passageway first portion 20*a* serving as a stop for the drainage mat. In another example embodiment, the vent panel 37 may extend from a level below the upper and end and above the lower end of the inner panel.

In an example embodiment, as shown in FIG. 3, to properly vent the entire length of the wall or substrate 11, a lower ventilation member (e.g. a screed) is also used. The lower ventilation member maybe a mid-wall ventilation member or a lower wall end ventilation member. An example lower ventilation member 40 has a base panel 42 and two legs, a lower leg 44, and an upper leg 46 extending transversely from a distal end of the base panel 42. The two legs are spaced apart from each other. In an example embodiment the lower ventilation member base panel 42 is doubled walled including a first wall 48, and as a second wall 50 adjacent the first wall 48, as shown in FIG. 3. The first wall 48 extends the entire height of the lower ventilation member base panel and the lower leg 44 extends transversely from the lowest end of the first wall. The second wall 50 extends to a location above the first wall lowest end and the upper leg 46 extends transversely from the second wall lowest end such that it is spaced apart from the upper leg 46. Drain openings 54 are formed at a proximal end portion of the upper leg 46.

When the lower ventilation member is used, it is mounted on the wall such that the lower leg 44 extends from, or proximate, the lower end of the wall. The water resistive barrier layer 28 that is attached over the base panel 12 of the ventilation member 10 extends over the base panel 42 of the lower ventilation member so as to cover the entire, or substantially the entire, lower ventilation member base panel up to the upper leg 46 as shown in FIG. 3. In an example embodiment where the water resistive barrier layer is placed between the ventilation member 10 base panel and the substrate 11, the water restive barrier layer also extends so as to be between the lower ventilation member base panel and the substrate. The drainage mat extends to adjacent or almost adjacent the upper leg 46 of the lower ventilation member and it is aligned with the drain openings 54 formed on the upper leg 46. The lath 32 also extends over the drainage mat up to the second leg. The wall cladding 33 also extends to the upper leg 46, as for example shown in FIG. 3. In this regard any moisture within the drainage mat can also drain downwards along the drainage mat, through the lower end 31*d* of the drainage mat, through the drain openings formed on the second leg, and drain through the space between the two legs and on the lower leg, as shown by arrows 58. In an example embodiment the lower leg is inclined downward to aid in the drainage. The upper leg is also inclined downward to aid in drainage that may try to occur between the stucco and the second leg. In another example embodiment, the lower ventilation member is provided with only the upper leg 46 or with no legs at all.

The first and second ventilation members also allow external air to ventilate the system through the drainage mat. In addition, by the drain opening 54 and the passageway first portion 20*a* being aligned with the drainage mat, clogging of the drain opening 54 and the first passageway 20*a* by the cladding (e.g., stucco) is prevented.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. For example, the first or upper ventilation member shown in FIG. 3 can be any of the first or upper ventilation members described herein, as for example the ventilation member shown in FIG. 5. Moreover, although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" or "over" another component, it can be directly on or over the other component, or components may also be present therebetween. Moreover, when a component is component is referred to as being "coupled" to another component, it can be directly attached to the other component or intervening components may be present therebetween.

The invention claimed is:

1. A ventilation member comprising:

a base panel for mounting onto a substrate;

an upper panel extending transversely from the base panel;

a lower panel spaced apart from the upper panel and below the upper panel; and an inner panel extending transversely from the lower panel, wherein a passageway is defined having a first portion defined between the base panel and the inner panel and a second portion extending transversely from the first portion and defined between the upper and the lower panels.

2. The ventilation member of claim 1, further comprising a connecting panel connecting the upper and lower panels at distal ends thereof.

3. The ventilation member of claim 2, wherein a vent opening is formed through a distal portion of the lower panel for venting said passageway.

4. The ventilation member of claim 3, further comprising a guide extending transversely from the lower panel for providing a guide for an addition of an exterior cladding.

5. The ventilation member of claim 4, further comprising a leg extending from the lower panel at a distal end thereof, wherein the vent opening is located between the guide and said leg.

6. The ventilation member of claim 1, wherein the inner panel extends upward from the lower panel.

7. The ventilation member of claim 6, further comprising a vent panel comprising at least one opening, said vent panel extending from the base panel to the inner panel.

8. The ventilation member of claim 7, wherein the ventilation member further comprises a vertical panel extending from a distal end of the upper panel toward the lower panel defining a gap between a distal end of said vertical panel and a distal end of the lower panel for venting.

9. The ventilation member of claim 8, further comprising a guide extending from the distal end of the lower panel.

10. The ventilation member of claim 8, wherein the base panel comprises a second wall over a first wall, wherein the upper panel extends from the first wall and the lower panel extend from the second wall.

11. The ventilation member of claim 1, wherein the base panel is for being sandwiched between a substrate and a water resistive barrier layer.

12. The ventilation member of claim 1, wherein the base panel is for being mounted on a substrate covered by a water resistive barrier layer.

13. The ventilation member of claim 1, wherein the base panel, the upper panel, the lower panel and the inner panel are integrally formed from a single piece of material.

14. The ventilation member of claim 1, further comprising at least one protrusion extending from at least one of the base panel and the inner panel and into the passageway first portion.

15. The ventilation member of claim 1, further comprising a vent panel extending from the base panel to the inner panel, said vent panel comprising at least one opening.

16. A structure venting system comprising:

a substrate being part of said structure;

a first ventilation member comprising, a base panel mounted to said substrate, an upper panel extending transversely from the base panel, a lower panel spaced apart from the upper panel, and an inner panel extending transversely from the lower panel, wherein a passageway is defined having a first portion defined between the base panel and the inner panel and a second portion extending transversely from the first portion and defined between the upper and the lower panel;

a water resistive barrier layer adjacent said base panel; and a drainage mat over said substrate and water resistive barrier layer and extending into the passageway first portion, wherein moisture in the drainage mat can vent through the passageway.

17. The system of claim 16, wherein the water resistive barrier layer is over the base panel, wherein the base panel is sandwiched between the substrate and the water resistive barrier layer.

18. The system of claim 16, wherein the water resistive barrier layer is over the substrate, wherein the water resistive barrier layer is sandwiched between the substrate and the base panel.

19. The system of claim 16, further comprising:

a lath over the drainage mat; and a cladding over the lath.

20. The system of claim 16, further comprising a connecting panel connecting the upper and lower panels at distal ends thereof.

21. The system of claim 20, wherein a vent opening is formed through a distal portion of the lower panel for venting said passageway.

22. The system of claim 21, further comprising a guide extending transversely from the lower panel for providing a guide for an addition of the exterior cladding.

23. The system of claim 22, further comprising a leg extending from the lower panel at a distal end thereof, wherein the vent opening is located between the guide and said leg.

24. The system of claim 16, wherein the inner panel extends upward from the lower panel.

25. The system of claim 24, further comprising a vent panel comprising at least one opening, said vent panel extending from the base panel to the inner panel, wherein said vent panel acts as a stop for preventing travel of the drainage mat beyond said vent panel.

26. The system of claim 25, wherein the first ventilation member further comprises a vertical panel extending from a distal end of the upper panel toward the lower panel defining a gap between a distal end of said vertical panel and a distal end the lower panel for venting.

27. The system of claim 26, further comprising a guide extending from the distal end of the lower panel for providing a guide for an addition of the exterior cladding.

28. The system of claim 27, wherein the base panel comprises a second wall over a first wall, wherein the upper panel extends from the first wall and the lower panel extend from the second wall.

29. The system of claim 16, further comprising at least one protrusion extending from at least one of the base panel and the inner panel and into the passageway first portion, said at least one protrusion acting as a stop for preventing travel of the drainage mat beyond said at least one protrusion.

30. The system of claim 16, further comprising a vent panel extending from the base panel to the inner panel, said vent panel comprising at least one opening, said vent panel acting as a stop for preventing travel of the drainage mat beyond said vent panel.

31. The system of claim 16, further comprising a second ventilation member, said second ventilation member comprising:

a base panel, wherein a portion of the water resistive barrier layer extends adjacent said second ventilation member base panel and a portion of the draining mat extends over said second ventilation member base panel and said portion of the water resistive barrier layer; and a first leg extending transversely from said second ventilation member base panel, said first leg comprising a drain opening aligned with said drainage mat, wherein moisture within said drainage mat can drain through said drain opening.

32. The system of claim 31, wherein the second ventilation member comprises a second leg extending transversely and downwardly from the second ventilation member base panel spaced apart and below said first leg of said second ventilation member, wherein moisture drained through said drain opening of said first leg drains on said second leg and is guided by said second leg.

33. The system of claim 31, wherein the water resistive barrier layer is over the base panel of the ventilation member and over the base panel of the second ventilation member, wherein said base panels are sandwiched between the substrate and the water resistive barrier layer.

34. The system of claim 31, wherein the water resistive barrier layer is over the substrate, wherein the water resistive barrier layer is sandwiched between the substrate and the base panel of the ventilation member and between the substrate and the base panel of the second ventilation member.

35. A ventilation member comprising:

a base panel for mounting onto a substrate;

an upper panel extending transversely from the base panel;

a lower panel spaced apart from the upper panel and below the upper panel; and an inner panel extending transversely from the lower panel, wherein a passageway is defined having a first portion defined between the base panel and the inner panel and a second portion extending transversely from the first portion and defined between the upper and the lower panels wherein a vent opening is formed through a distal portion of the lower panel for venting said passageway.

36. The ventilation member of claim 35, further comprising a guide extending transversely from the lower panel for providing a guide for an addition of an exterior cladding.

37. The ventilation member of claim 36, further comprising a leg extending from the lower panel at a distal end thereof, wherein the vent opening is located between the guide and said leg.

38. The ventilation member of claim 35, wherein the inner panel extends upward from the lower panel.

39. The ventilation member of claim 38, further comprising a vent panel comprising at least one opening, said vent panel extending from the base panel to the inner panel.

40. The ventilation member 39, wherein the ventilation member further comprises a vertical panel extending from a distal end of the upper panel toward the lower panel defining a gap between a distal end of said vertical panel and a distal end of the lower panel for venting.

41. The ventilation member of claim 40, further comprising a guide extending from the distal end of the lower panel.

42. The ventilation member of claim 40, wherein the base panel comprises a second wall over a first wall, wherein the upper panel extends from the first wall and the lower panel extend from the second wall.

43. The ventilation member of claim 35, wherein the base panel, the upper panel, the lower panel and the inner panel are integrally formed from a single piece of material.

44. The ventilation member of claim 35, further comprising at least one protrusion extending from at least one of the base panel and the inner panel and into the passageway first portion.

45. The ventilation member of claim 35, further comprising a vent panel extending from the base panel to the inner panel, said vent panel comprising at least one opening.

* * * * *